US008205819B2

(12) United States Patent
Groff et al.

(10) Patent No.: US 8,205,819 B2
(45) Date of Patent: Jun. 26, 2012

(54) AUTOMATED DEREELER

(75) Inventors: Andrew T. Groff, Linn, MO (US); Stephen J. Schmidt, Linn, MO (US); Thomas E. Dotson, Belle, MO (US)

(73) Assignee: ABB Technology AG, Zurich (CH)

( * ) Notice: Subject to any disclaimer, the term of this patent is extended or adjusted under 35 U.S.C. 154(b) by 158 days.

(21) Appl. No.: 12/575,181

(22) Filed: Oct. 7, 2009

(65) Prior Publication Data

US 2010/0090051 A1 Apr. 15, 2010

Related U.S. Application Data

(60) Provisional application No. 61/104,353, filed on Oct. 10, 2008.

(51) Int. Cl.
*B65H 59/02* (2006.01)

(52) U.S. Cl. ..... 242/420.6

(58) Field of Classification Search ..... 242/416, 242/418, 418.1, 419.1, 419.9, 420–420.6, 242/421.5–421.7, 423.1, 155 M, 155 BW; 226/39

See application file for complete search history.

(56) References Cited

U.S. PATENT DOCUMENTS 4,967,973 A * 11/1990 Murnane ..... 242/413.5
4,984,341 A * 1/1991 Hagewood et al. ..... 28/185
5,310,124 A * 5/1994 Linari et al. ..... 242/418.1
6,152,396 A * 11/2000 Rapila et al. ..... 242/420.6

* cited by examiner

*Primary Examiner* — William E Dondero
(74) *Attorney, Agent, or Firm* — Michael C. Prewitt; Paul R. Katterle

(57) ABSTRACT

An automatic dereeler includes a rocker arm that is movable between various positions to indicate the relative tension on a continuously supplied material. A sensor detects the rocker arm position which is transmitted to a controller. The controller actively controls a motor to either increase or decrease the resistive torque on a rotating axle that carries the continuous material.

10 Claims, 5 Drawing Sheets

AUTOMATED DEREELER

PRIORITY CLAIM

This application claims priority to provisional application No. 61/104,353, filed on Oct. 10, 2008 titled Automated Dereeler, the contents of which are incorporated by reference in their entirety.

BACKGROUND

Many manufacturing processes require the input of continuous materials such as coils, straps, etc. These materials are typically supplied in spools that are paid out during fabrication of a product. For example, transformer coil making machines require a continuous feed of coil material, wherein numerous turns of the coil material are wrapped onto a core. To prevent jamming and otherwise improve machine performance, it is advantageous to supply the coil material at a relatively constant tension.

Thus there is a need in the art for a dereeler having automated control of tension to provide relatively constant tension within predefined ranges.

SUMMARY OF THE INVENTION

According to one aspect of the present invention an automated dereeler is provided for feeding spools of continuous material into a machine. The dereeler includes a housing rotatably carrying an axle which has a first end. The axle carries the spool of continuous material at the first end. A motor is secured proximate to the housing and is mechanically interconnected to the axle. A brake is secured to the housing and is positioned to provide a constant braking torque to the axle. A dancer arm is pivotally secured to the housing and is movable between a first position and a second position. The dancer arm includes a spindle around which the continuous material is fed into the machine. A spring assembly has a first end and a second end, the first end being secured to the housing and the second end being secured to the dancer arm. The spring assembly biases the dancer arm toward the first dancer arm position. A sensor is adapted to monitor the position of the dancer arm. A controller controls the motor and is in communication with the sensor. The controller causes the motor to resist rotation of the axle when the dancer arm is in the first dancer arm position. The controller causes the motor to aid rotation of the axle when the dancer arm is in the second dancer arm position.

BRIEF DESCRIPTION OF THE DRAWING FIGURE(S)

Figure 5A:
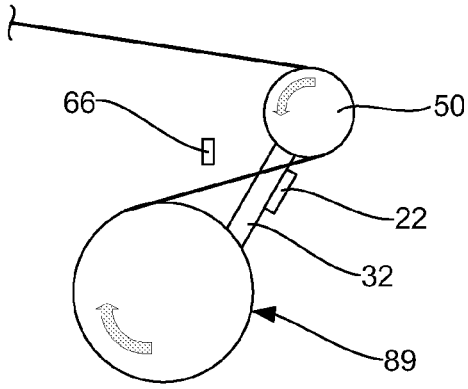
FIG. 5*a* is a partially schematic view of the dereeler with the dancer arm in a first, resting position.
Figure 5B:
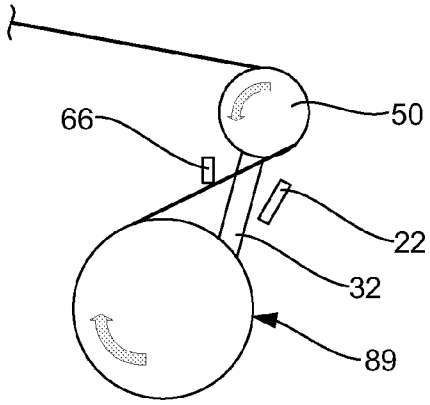
Figure 5C:
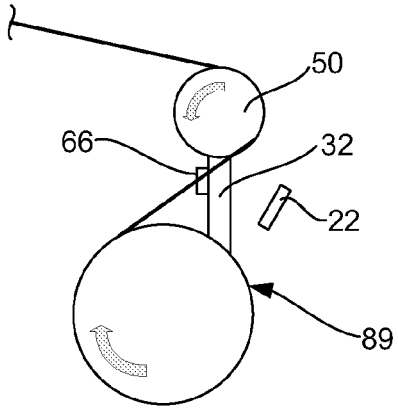

FIG. 5*b* is a partially schematic view of the dereeler with the dancer arm in a third, neutral position; and FIG. 5*c* is a partially schematic view of the dereeler with the dancer arm in a second, forward position.

DETAILED DESCRIPTION OF THE ILLUSTRATIVE EMBODIMENT(S)

With reference now to FIGS. 1-4 a dereeler 10 is shown and generally indicated by the numeral 10. Dereeler 10 includes a frame 12 having a pair of opposed, vertically extending sections 14 in the form of plates. Vertically extending sections 14 are spaced by a bottom laterally extending section 16 and a top laterally extending section 18. Bottom laterally extending section 16 extends substantially the entire length of vertically extending sections 14. Top laterally extending section 18 extends less than the entire length of the vertically extending sections 14. Two feet 20 are secured to the bottom of bottom laterally extending section 16 and vertically extending sections 14 and extend laterally for improved frame stability.

It should be appreciated that any frame or other structural element may be made of any metal or other material of suitable strength. The frame and/or structural elements may be of any form including, plates, tubes, hollow rectangular, corrugated, etc. Though the components of the frame are shown as welded in the figures, it should be appreciated that other means of attachment may be utilized, such as, for example treaded fasteners or riveting. Still further, frame 12 may be cast and one or more components may be formed as a single unified component.

Frame 12 includes an arm stop 22 extending upwardly at an angle from a first edge 24 of vertically extending sections 14. Arm stop 22 includes two connecting sections 26 attached to first edge 24. Connecting sections support a stop plate 28 that extends between connecting sections 26 and includes a stop surface 30. As will be hereinafter described in greater detail, stop surface 30 is positioned to engage a dancer arm 32.

A first and second extending portion 34 and 36 respectively extend upwardly from an outer vertically extending surface 38 of top laterally extending section 18. First and second extending portions 34 and 36 each include an axially aligned hole 40. A shaft block 42 is positioned between first and second extending portions 34 and 36. Shaft block 42 includes a pair of outwardly extending circular projections 44 that are received in holes 40 such that shaft block 42 is rotatable about the axis formed by holes 40. Shaft block 42 further includes a central aperture 46 which is adapted to slidably receive a cylindrical spring carrier 48.

Figure 1:
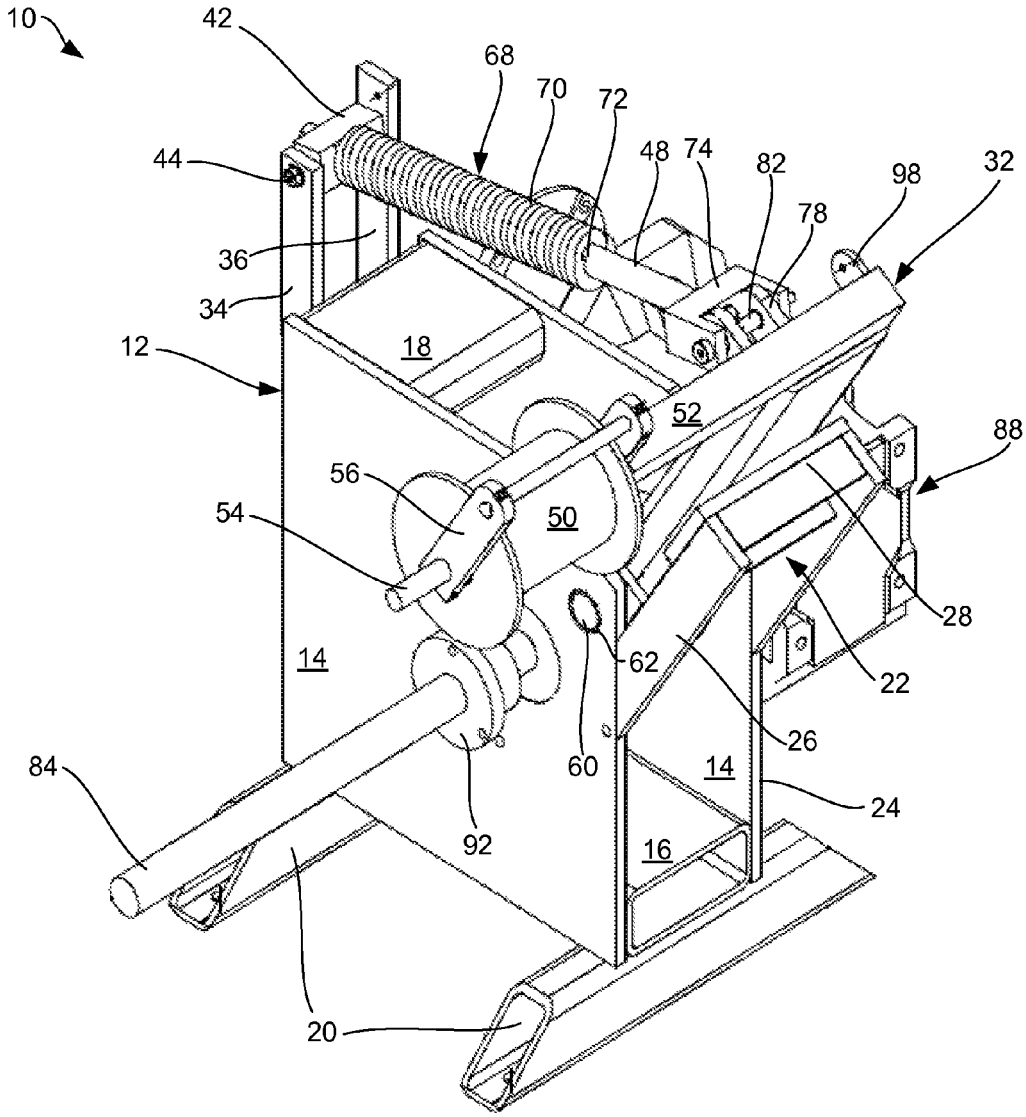
FIG. 1 shows a perspective view of a dereeler according to the present invention.
Figure 2:
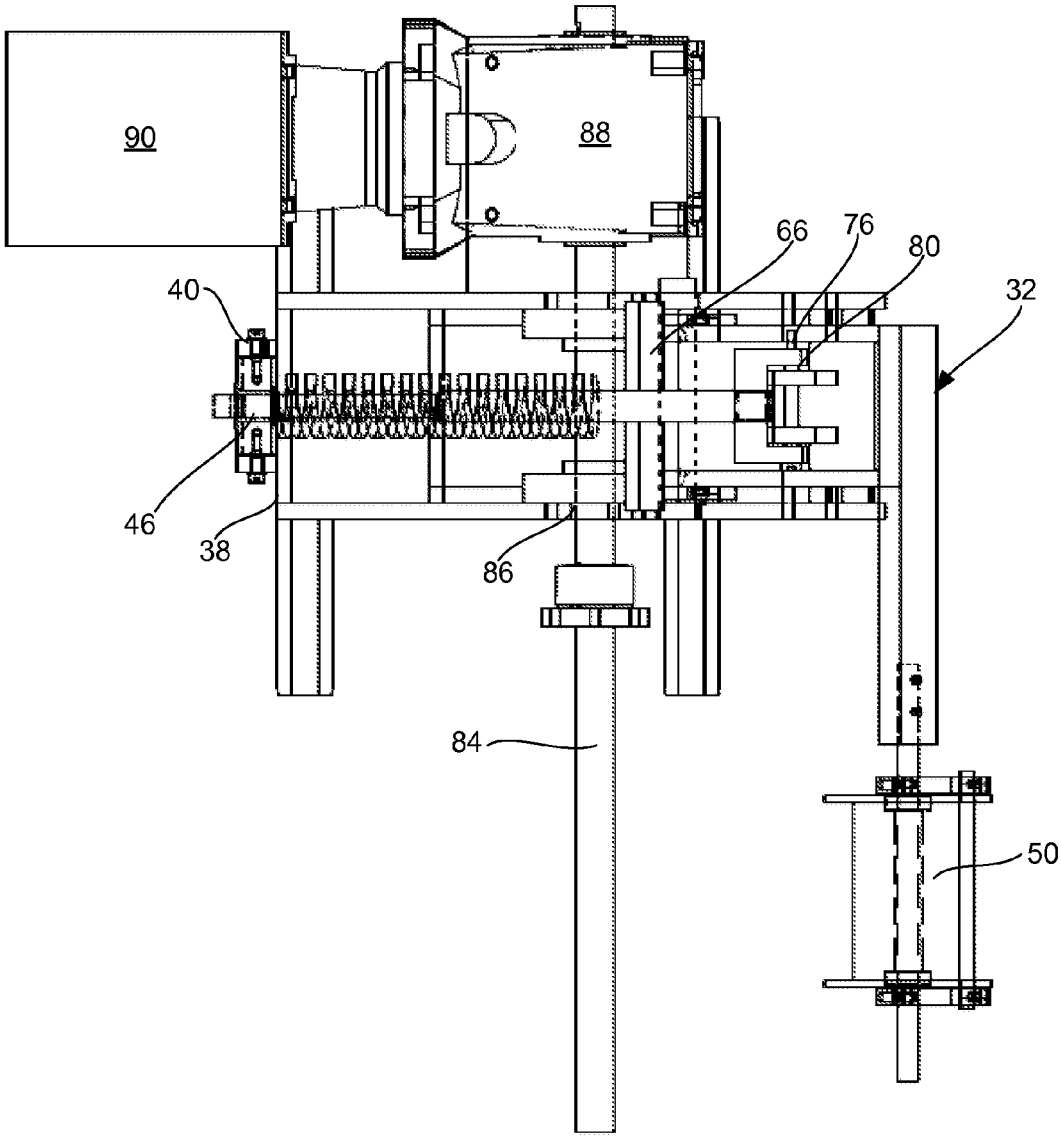
FIG. 2 shows a top view of the dereeler of FIG. 1 with a motor shown.
Figure 3:
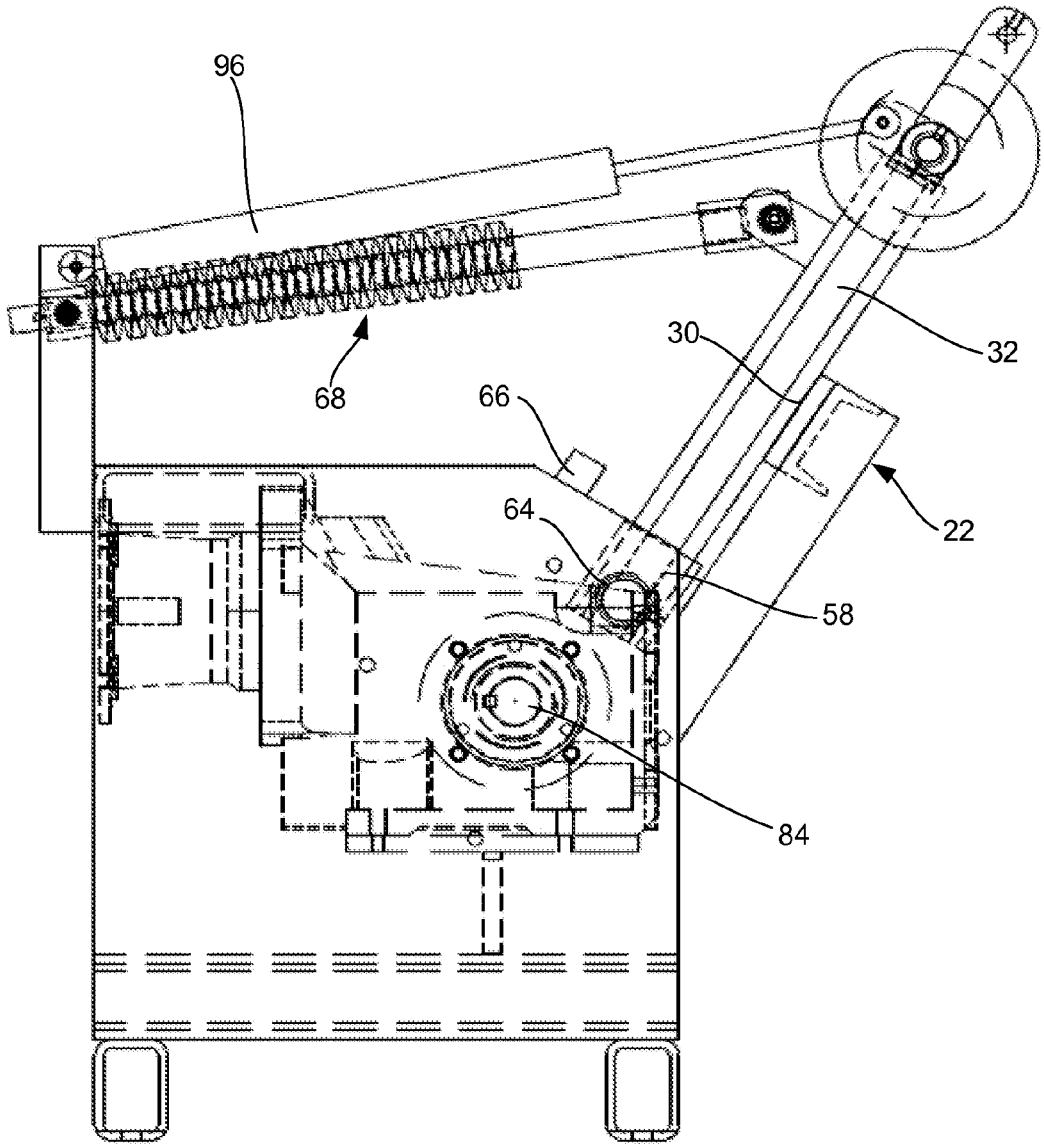
FIG. 3 shows a side view of the dereeler of FIG. 1 with the transducer shown.
Figure 4:
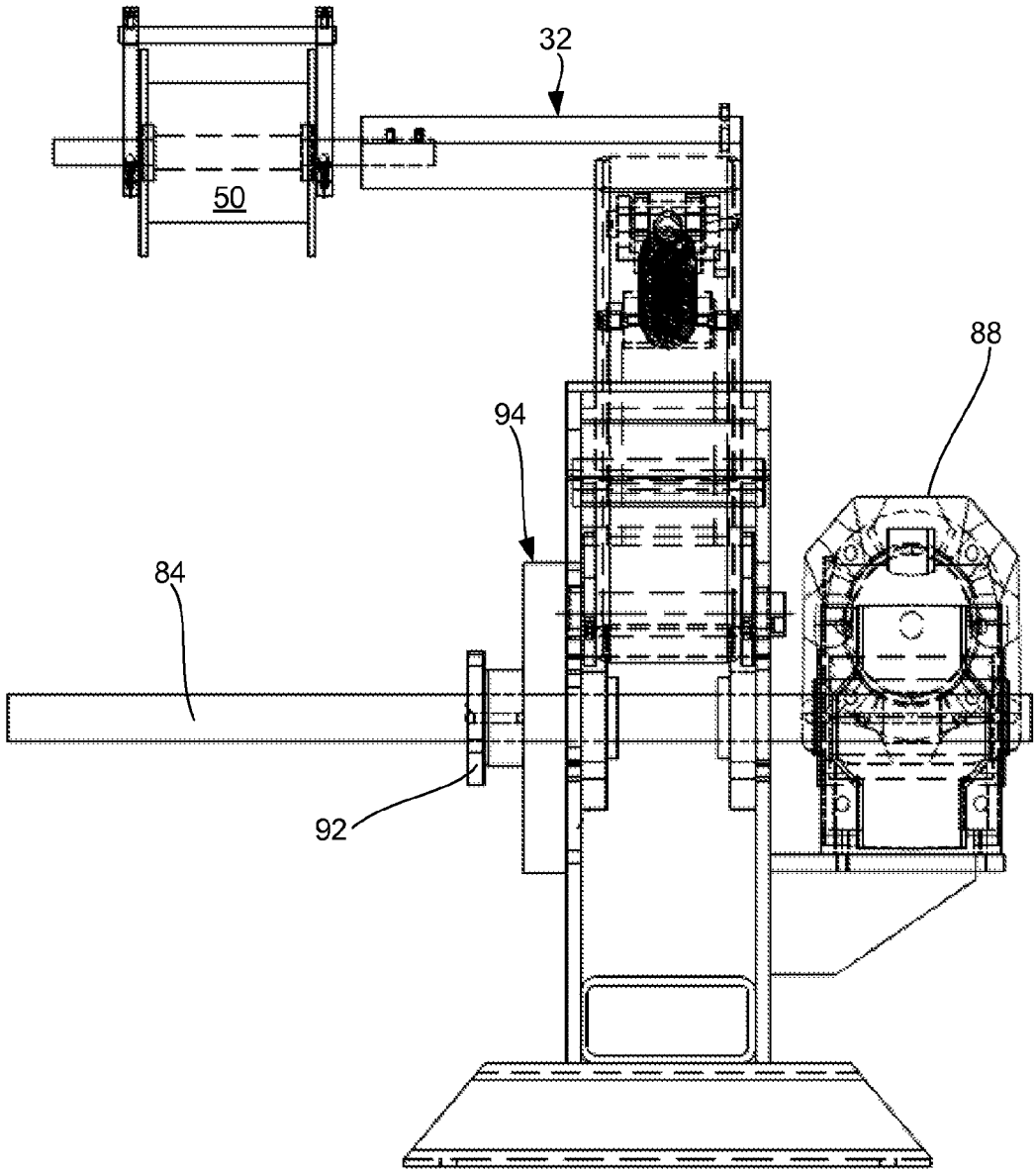
FIG. 4 is a front view of the dereeler of FIG. 1 with the brake shown.

Dancer arm 32 is generally L-shaped and is adapted to carry a spindle 50 at a first end 52. To that end, a cylindrical spindle shaft 54 extends from first end 52 and rotatably carries spindle 50. Spindle shaft 52 further carries a U-shaped guide 56 which does not rotate and is positioned around spindle 50. Dancer arm 32 is carried by, and rotatable about, a cylindrical arm shaft 60. Arm shaft 60 extends between vertically extending sections 14 and is received within bores 62. Dancer arm 32 includes a second end 58 having bores 64 that receive arm shaft 60. In this manner, dancer arm 32 may pivot about arm shaft 60. The pivoting motion is, however, limited. With reference to FIG. 3, clockwise rotation is bounded by arm stop 22. Likewise, counterclockwise movement is bounded by a restraining bar 66 that extends between vertically extending sections 14.

Dancer arm 32 is biased toward arm stop 22 by a spring assembly 68. Spring assembly 68 includes the aforementioned spring carrier 48 which carries a spring 70 positioned axially centered on the cylindrical spring carrier 48. According to one embodiment, spring 70 is a die spring. Spring 70 is maintained in compression between shaft block 42 and a raised catch 72. At the end of spring carrier 48 opposed from shaft block 42 is a U-shaped member 74 having a pair of opposed holes 76. Dancer arm 32 includes a pair of raised flanges 78 having a pair of opposed holes 80. A pin 82 is secured within holes 76 and holes 80 to pivotally secure spring assembly 68 to dancer arm 32. As should be evident, spring 70 biases dancer arm 32 toward arm stop 22. However, if an opposing force overcomes the spring bias, rotation of dancer arm 32 is possible because spring carrier 48 may slide through central aperture 46.

A spool axle 84 extends through bores 86 in vertically extending sections 14. Spool axle 84 extends from both sides of frame 12. A first end is rotationally coupled to a gearbox 88. Gear box 88 is in turn rotationally coupled to a motor 90. In this manner, motor 90 imparts a torque on spool axle 84 to cause rotation and/or resist rotation (i.e. a braking force). Motor 90 is driven by a variable frequency drive (hereinafter VFD) that is responsive to signals from a controller. The controller may be any device capable of receiving sensory signals and outputting control commands. According to one embodiment, the controller is a programmable logic controller (hereinafter PLC). An exemplary PLC may include an Omron PLC using DeviceNet communication and an analog signal. The PLC may be used to control just dereeler 10 or may control the entire manufacturing machine in addition to dereeler 10. In still other embodiments, the PLC is integrated with or communicates with a separate PLC controlling one or more additional manufacturing operations.

The end of spool axle 84 opposed from gear box 88 carries a spool 89 (see FIG. 5) of wire, cable, or other continuous material used in a manufacturing process. A flange 92 is provided to rotationally couple the spool to the spool axle 84. In this manner, axle 84 and the spool rotate together.

A brake 94 (shown in FIG. 4) is secured to frame 12 and is positioned to apply a continuous braking force to spool axle 84. Though any number of brakes may be employed, it is advantageous to use a brake that applies substantially constant braking torque, efficiently dissipates heat and has a relatively high contact surface area. According to the present embodiment, an air pressure operated tensioning type brake is particularly advantageous. For example, a Nexen brand shaft mounted friction brake provides acceptable shaft braking performance.

A linear transducer 96 (shown in FIG. 3) is secured at one end to second extending portion 36 and at the other end to a tab 98 on dancer arm 32. Thus, it can be seen that linear transducer 96 outputs a continuous or periodic signal indicative of the angular position of dancer arm 32. Signal from the linear transducer 96 is output to the controller (PLC), which in-turn transmits command signals to the VFD.

As is known in the art, continuous material 100 (see FIG. 5) is drawn or pulled into a manufacturing machine. Thus, dereeler 10 advantageously provides a substantially constant resistance (i.e. tension) to the drawing in of the continuous material. Constant and well regulated tension prevents jamming and/or machine failure. As should be evident, the relative position of dancer arm 32 is dependent upon the tension on the continuous material. The greater the tension, the more the spring pressure is overcome and the dancer arm 32 will move forward.

Dereeler 10 is operable in a torque control mode. In the torque control mode, brake 94 is set at a constant pressure (i.e. constant torque). In this mode, if the dancer arm 32 is in a first, resting position, contacting arm stop 22 (see FIG. 5*a*), a reverse or braking torque is applied by motor 90. As should be appreciated, linear transducer 96 monitors the dancer arm position, transmits the position signal to the PLC, which in turn transmits the motor control commands to the VFD. When dancer arm 32 is in the first, resting position, the tension on the continuous material is relatively light, and not great enough to overcome the spring tension. This may represent a situation wherein the manufacturing machine is idle and not drawing any continuous material.

If dancer arm 32 is in a second, fully forward position (see FIG. 5*c*), resting against restraining bar 66, a forward rotating torque is applied by motor 90. Thus, the range of torques provided by the motor 90 is: at first, resting position, a 100% CCW torque (i.e. resisting the removal of continuous material from the spool), at second, forward position, a 100% CW torque (i.e. promoting removal of continuous material from the spool), at a third, center or optimal position, no CW or CCW torque is applied by motor 90. Thus, as material is pulled from the dereeler 10, the dancer arm 32 moves forward and motor reverse torque decreases. As the dancer arm 32 continues forward, reverse torque will continuously decrease until passing the third position, wherein motor torque now switches to forward torque (i.e. promoting rotation of spool 89)

A second, auxiliary mode is contemplated according to the present invention. Occasionally, an operator might overshoot the amount of continuous material needed, might need to make a repair or may need to change material. In such an instance, the motor 90 may be commanded to increase reverse torque enough (i.e. a torque greater than the braking torque supplied by brake 94) to pull the continuous back and rewind it on spool 89.

Thus, by way of an example, an operator may set the air pressure to 20 psi for the brake 94. This in turn results in a constant braking torque applied to spool axle 84. As a manufacturing machine draws continuous material (e.g. wire) from dereeler 10, dancer arm 32 moves forward. This is because rotation of spool axle 84 is prevented by both motor 90 and brake 94. As dancer arm 32 moves forward, reverse torque from motor 90 decreases. At some point in the forward movement of dancer arm 32, the force of the manufacturing machine pulling on the wire overcomes the combined resistive torque of the motor 90 and brake 94. This in turn allows material feed to the machine. In response to PLC commands, the VFD drives the motor 90 to provide scaled forward or reverse torque to the motor/gearbox as needed. The PLC reads the position of the transducer 96 and sends the appropriate signal levels.

As should be appreciated, the resistance of the dereeler is determined by summing the brake resistance with the motor/gearbox resistance, as controlled by the VFD. Thus, when the dancer arm 32 is in the first, resting position, the dereeler resistance is the brake resistance plus 100% motor/gearbox resistance torque. If the dancer arm 32 is in the third, neutral position, the dereeler resistance is only the brake resistance. And if the dancer arm 32 is in the second, forward position, the resistance is the brake resistance minus 100% motor/gearbox resistance. The motor/gearbox torque ramps up between 0 and 100% as the dancer arm 32 moves thus enabling fast closed loop control with high precision. It should be appreciated, that even when the dancer arm 32 is in the second, forward position, the resistance from brake 90 is greater than the torque provided by the motor/gearbox. In this manner, the continuous material is always under tension. The tension of the continuous material is effectively increase or decreased and regulated through the linear transducer, PLC and the VFD.

By way of a specific example, brake 90 is set at 20 psi and creates enough friction such that 35 ft-lbs of force is required to rotate spool axle 84 and the motor/gearbox is capable of 18 ft-lbs of force at 100%. If dancer arm 32 is positioned in the first, resting position, 53 ft-lbs of force is required to rotate the spool axle 84. As the arm moves forward, that force decreases in direct correlation to the angular position of dancer arm 32. If the arm is in the second, forward position, the required to rotate the spool axle is 17 ft-lbs.

As will be appreciated by one of ordinary skill in the art, the controlling mechanisms of the present invention may be embodied as or take the form of the method and system previously described, as well as of a computer readable medium having computer-readable instructions stored thereon which, when executed by a processor, carry out the operations of the present inventions as previously described and defined in the corresponding appended claims. The computer-readable medium may be any medium that can contain, store, communicate, propagate, or transport the program instruction for use by or in connection with an instruction execution system, apparatus, or device and may by way of example but without limitation, be an electronic, magnetic, optical, electromagnetic, infrared, or semiconductor system, apparatus, device, or propagation medium or other suitable medium upon which the program is printed. More specific examples (a non-exhaustive list) of the computer-readable medium would include: a portable computer diskette, a hard disk, a random access memory (RAM), a read-only memory (ROM), an erasable programmable read-only memory (EPROM or Flash memory), an optical fiber, a portable compact disc read-only memory (CD-ROM), DVD, an optical storage device, a transmission media such as those supporting the Internet or an intranet, or a magnetic storage device. Computer program code or instructions for carrying out operations of the present invention may be written in any suitable programming language provided it allows achieving the previously described technical results.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

We claim:

1. An automated dereeler for feeding spools of continuous material into a machine, said dereeler comprising:

a housing rotatably carrying an axle, said axle having a first end, said axle carrying the spool of continuous material at said first end;

a motor mechanically interconnected to said axle;

a brake secured to said housing and positioned to continuously provide a constant braking torque to said axle;

a dancer arm pivotally secured to said housing and movable between a first position and a second position, said dancer arm including a spindle around which the continuous material is fed into the machine;

a spring assembly having a first end and a second end, said first end being secured to said housing and said second end being secured to said dancer arm, said spring assembly biasing said dancer arm toward said first dancer arm position;

a sensor adapted to monitor the position of said dancer arm;

a controller for controlling said motor and in communication with said sensor; and wherein said controller causes said motor to resist rotation of said axle when said dancer arm is in said first dancer arm position, said controller causing said motor to aid rotation of said axle when said dancer arm is in said second dancer arm position.

2. The dereeler according to claim 1 wherein said dancer arm is movable to a third position, between said first position and said second position, wherein when said dancer arm is in said third position, said motor does not aid or resist rotation of said axle.

3. The dereeler according to claim 2 wherein said motor includes a maximum resistive torque, said controller causing an increase in resistive torque from said motor from zero when said dancer arm is at said third position to said maximum resistive torque when said dancer arm is at said first position.

4. The dereeler according to claim 2 wherein said motor includes a maximum aiding torque, said controller causing an increase in aiding torque from said motor from zero when said dancer arm is at said third position to said maximum aiding torque when said dancer arm is at said second position.

5. The dereeler according to claim 4, wherein said maximum aiding torque is less than said constant braking torque from said brake.

6. An automated dereeler for feeding spools of continuous material into a machine, said dereeler comprising:

a housing rotatably carrying an axle, said axle having a first end, said axle carrying the spool of continuous material at said first end;

a motor secured to said housing and mechanically interconnected to said axle;

a brake secured to said housing and positioned to continuously provide a constant braking torque to said axle;

a dancer arm pivotally secured to said housing and movable between a first position and a second position, said dancer arm including a spindle around which the continuous material is fed into the machine;

a spring assembly having a first end and a second end, said first end being secured to said housing and said second end being secured to said dancer arm, said spring assembly biasing said dancer arm toward said first dancer arm position;

a sensor adapted to monitor the position of said dancer arm and transmit sensor data;

a controller for controlling said motor and in communication with said sensor, said controller including a processor, a storing unit for storing signals, and software program instructions which are stored in said storing unit and when executed by the processor cause the controller to perform a method comprising:

monitoring said sensor data;

causing said motor to resist rotation of said axle when said dancer arm is in said first dancer arm position, and causing said motor to aid rotation of said axle when said dancer arm is in said second dancer arm position.

7. The dereeler according to claim 6 wherein said dancer arm is movable to a third position between said first position and said second position, said program instructions causing said motor to neither aid or resist rotation of said axle when said dancer arm is in said third position.

8. The dereeler according to claim 7 wherein said motor includes a maximum resistive torque, said program instructions causing an increase in resistive torque from said motor from zero when said dancer arm is at said third position to said maximum resistive torque when said dancer arm is at said first position.

9. The dereeler according to claim 7 wherein said motor includes a maximum aiding torque, said program instructions causing an increase in aiding torque from said motor from zero when said dancer arm is at said third position to said maximum aiding torque when said dancer arm is at said second position.

10. The dereeler according to claim 9, wherein said maximum aiding torque is less than said constant braking torque from said brake.

* * * * *